US009200370B2

(12) United States Patent
Doye et al.

(10) Patent No.: US 9,200,370 B2
(45) Date of Patent: Dec. 1, 2015

(54) METHOD FOR FABRICATING A LAYER WITH ABSORBING PARTICLES FOR AN ENERGY RADIATION

(75) Inventors: Christian Doye, Berlin (DE); Jens Dahl Jensen, Berlin (DE); Ursus Krüger, Berlin (DE); Kathrin Kunert, Berlin (DE); Raymond Ullrich, Schönwalde (DE); Gabriele Winkler, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 912 days.

(21) Appl. No.: 13/322,432

(22) PCT Filed: May 12, 2010

(86) PCT No.: PCT/EP2010/056546

§ 371 (c)(1),
(2), (4) Date: Jan. 27, 2012

(87) PCT Pub. No.: WO2010/136338

PCT Pub. Date: Dec. 2, 2010

(65) Prior Publication Data

US 2012/0128872 A1 May 24, 2012

(30) Foreign Application Priority Data

May 27, 2009 (DE) ..... 10 2009 023 628

(51) Int. Cl.
*C23C 18/14* (2006.01)
*C23C 18/12* (2006.01)

(52) U.S. Cl.
CPC ..... *C23C 18/14* (2013.01); *C23C 18/127* (2013.01); *C23C 18/1208* (2013.01); *C23C 18/1216* (2013.01); *C23C 18/1225* (2013.01)

(58) Field of Classification Search
CPC .... C04B 41/52; C04B 38/0022; C23C 18/14; C23C 18/1208; B32B 2315/02
USPC ..... 427/559; 264/430, 432
See application file for complete search history.

(56) References Cited

U.S. PATENT DOCUMENTS 5,585,136 A 12/1996 Barrow et al.
6,362,121 B1 3/2002 Chopin et al.

(Continued)

FOREIGN PATENT DOCUMENTS

DE 696 11 618 T2 8/2001
DE 696 14 673 T2 6/2002

(Continued)

OTHER PUBLICATIONS

International Search Report for PCT/EP2010/056546; mailed Dec. 6, 2010.

(Continued)

*Primary Examiner* — Joel Horning
(74) *Attorney, Agent, or Firm* — Staas & Halsey LLP

(57) ABSTRACT

A ceramic layer is fabricated on a substrate by coating the substrate with a material containing chemical precursors of a ceramic. The precursors are transformed by a heat treatment into the ceramic to be fabricated. Different methods for heat insertion may be used for individual layers by absorbing particles, which are utilized in different concentrations or different chemical compositions. A targeted heat insertion even in lower layer regions, for example, by microwave animation, or ultraviolet or infrared light insertion is therefore possible. Beneficially, as a result, comparatively thick layers in particular can be fabricated by a single heat treatment layer.

14 Claims, 1 Drawing Sheet

(56) References Cited

U.S. PATENT DOCUMENTS

| | | | | |
|---|---|---|---|---|
| 2006/0280955 | A1* | 12/2006 | Spitsberg et al. | 428/446 |
| 2009/0274850 | A1* | 11/2009 | Bhatia et al. | 427/540 |
| 2010/0215869 | A1 | 8/2010 | Jensen et al. | |
| 2010/0221423 | A1 | 9/2010 | Jensen et al. | |

FOREIGN PATENT DOCUMENTS

| | | | |
|---|---|---|---|
| DE | 102007026626 | B3 | 9/2008 |
| WO | 00/00660 | | 1/2000 |
| WO | 2009/000657 | A2 | 12/2008 |
| WO | 2009/000676 | A2 | 12/2008 |

OTHER PUBLICATIONS

German Office Action for Application No. 102009023628.7; dated Sep. 30, 2009.

102009023627.7, May 27, 2009, Christian Doye et al., Siemens Aktiengesellschaft.

* cited by examiner

METHOD FOR FABRICATING A LAYER WITH ABSORBING PARTICLES FOR AN ENERGY RADIATION

CROSS REFERENCE TO RELATED APPLICATIONS

This application is the U.S. national stage of International Application No. PCT/EP2010/056546, filed May 12, 2010 and claims the benefit thereof. The International Application claims the benefits of German Application No. 102009023628.7 filed on May 27, 2009, both applications are incorporated by reference herein in their entirety.

BACKGROUND

Described below is a method for producing a layer on a substrate. According to this method, a coating material which contains a solvent or dispersion medium, chemical precursors of a ceramic and absorber particles for an energy radiation is applied onto the substrate. The substrate provided with the coating material is then subjected to a heat treatment in which the solvent or dispersion medium is evaporated and the chemical precursors are converted into the ceramic so as to form the layer, the heat treatment including input of an electromagnetic energy radiation which is converted into heat by the absorber particles. The absorber particles therefore are formed of a material which makes it possible to absorb the energy radiation. The energy radiation must provide an energy which can be absorbed by particular absorber materials and be appropriately selected to suit the absorber particles used. Electromagnetic radiation is in particular used as the energy radiation and a wealth of materials are available for the selection of the material of the absorber particles (further details on this below), so that a material which suits the layer system to be produced can be selected as a function of the application.

The method of producing ceramic layers from chemical precursors of the ceramic is known per se. For example, such a method is described in WO 00/00660 A. The chemical precursors of the ceramic are materials which do not themselves belong to the material group of ceramics, but can be dissolved in solvents or dispersed in dispersion media. In this way, a liquid or paste is obtained which can be applied onto the substrate to be coated. A subsequent heat treatment is used first to evaporate the solvent or dispersion medium, so that the layer can solidify. A subsequent sintering treatment leads to crosslinking of the precursors to form the desired ceramic (pyrolysis). By applying a plurality of coats with different compositions, so-called multilayer or gradient layers, in which the layer composition changes continuously or stepwise, can also be produced by the method.

The input of heat during the heat treatment is typically carried out in an oven in which the substrate with the applied layer is heated to the desired temperature. According to DE 10 2007 026 626 B3, however, it is described that input of heat can also be carried out in a controlled way in that, for example, particles of a UV light absorber such as titanium oxide or zinc oxide can be incorporated into the layer. The heat treatment can then be carried out, or at least assisted, by UV light irradiation.

SUMMARY

An aspect is to provide a method for producing a layer on a substrate by heat treatment of chemical precursors of a ceramic, which offers comparatively wide latitude for the adaptation of the layers to the intended application, while being economically employable.

To accomplish this, the method specified in the introduction applies a coating material having the absorber particles only for a part of the volume of the layer, and at least one further coating material, containing a solvent or dispersion medium and chemical precursors of a ceramic, is used for the rest of the volume of the layer. In other words, a plurality of coating materials are used for the method, which differ from one another at least in respect of the choice of absorber particles. The first coating material always contains some type of absorber particles, while the further coating material or the further coating materials contains or contain either no absorber particles or different absorber particles to the first coating material. The advantage of the use of absorber particles is that they can be adapted expediently to the requirements of the method for a particular application.

For example, comparatively thick layers can be produced in the manner described, in which case the lower coats in the vicinity of the substrate may be provided with absorber particles. If these layers are subsequently subjected to a known heat treatment in an oven, then the superficial coats of the layer are heated first while the coats close to the substrate in the layers would require a longer time for this. In this region, however, the input of heat can be accelerated by introducing an energy radiation suited to the absorber particles used, so that homogeneous heating and conversion of the chemical precursors in the layer into the ceramic to be produced can be ensured. In this way, advantageously, a thermal load on the substrate is reduced, the treatment time for the heat treatment is shortened and formation of internal stresses in the layer is counteracted. It is furthermore possible to avoid alternate application of layer material and conducting of a heat treatment for larger layer thicknesses. It is thus possible both to produce layers with higher quality and to save on manufacturing outlay and therefore costs.

By introducing absorber particles only into a particular part of the volume of the layer, it is advantageously also possible to produce layers in which ceramics are used which require different temperatures during the heat treatment. The ceramic for which the temperature is higher may be provided with the absorber particles, or alternatively may be provided with a higher concentration of absorber particles, so that higher temperatures result in this region during the heat treatment.

Advantageously, parts of the layer volume which contain different coating materials are individual coats of a multilayer coating. The different subvolumes of the layer are obtained by applying the different coating materials in succession. In this way, it is also possible to produce dispersion layers if, during the subsequent heat treatment of the layer, layer constituents diffuse and thus contribute to concentration equilibration between the coats. This leads to a concentration gradient which constitutes the properties of the gradient layer.

The subvolumes of the layer to be produced may, however, also be distributed other than in coats. For example, layer regions with different functions may be produced on the substrate. For example, it is conceivable to produce subregions of the layer with particular properties such as electrical conductivity or wear resistance.

According to an advantageous configuration of the method, absorber particles are also used in the further coating material or at least one of the further coating materials, this use differing in respect of the concentration of absorber particles in the coating material and/or the chemical composition of the absorber particles and/or the mixing ratio of absorber particles of different types. The composition of the absorber particles may advantageously be used so that it is possible to work with different types of energy radiation simultaneously or in succession during the heat treatment. Each energy radiation may then be used to deliberately influence the temperature in particular layer volumes. With the aid of the absorber particles of different composition, it is also possible to use energy rays which have different specific penetration depths into the layer (further details below). The concentration of absorber particles in the coating material determines the heat energy which can be converted in the relevant coat by irradiation of the layer. In this way, in particular, the rate of heating can be influenced. By setting different mixing ratios of absorber particles of different types in a particular coat, it is also possible to use energy radiations of different types.

It is particularly advantageous to apply a coat of a coating material having absorber particles for microwaves, and to apply thereon a coat of a coating material having absorber particles for infrared (IR) and/or ultraviolet (UV) light. This makes use of the fact that microwaves as electromagnetic radiation have a greater penetration depth into the layer than IR or UV light.

A layer formed in the manner indicated may thus be heated by simultaneous irradiation with IR light or UV light and with microwaves, in which case, with suitable selection of the concentration of absorber particles in the coats, uniform heating of the layer is obtained and the formation of a temperature gradient inside the layer can be avoided during the heat treatment.

Advantageously, however, the different energy radiations may also be used to heat the coats of the layer successively in a desired sequence. To this end, the energy radiations are used successively in a sequence and, for example, it is possible for the coat on the substrate to be converted into a ceramic first and only then for the coats above it to be converted. This has a positive effect on the bonding of the layer or the formation of internal stresses in the layer.

Advantageously, the coating material may also be applied on the substrate with regions of different thickness, and comparatively more absorber particles may be used in the regions of greater thickness. In this way, it is advantageously possible even for layers which locally have a different thickness on the substrate to be cured in one heat treatment. The regions of greater layer thicknesses, which would require a longer treatment time with known heating in an oven, are provided with absorber particles so that the latter lead to additional input of heat into this region, with the result of more rapid heating. The concentration of absorber particles may be adjusted so that the treatment time for the layer region of greater thickness is matched to the treatment time of the regions of smaller thickness.

The introduction of absorber particles is also particularly advantageous in the case of large-area workpieces, since the input of heat by the absorber particles during the heat treatment can take place with great homogeneity. This is conducive to a uniform layer structure even if, for example, microwaves are only introduced locally into a particular region of the layer surface of the large-area workpiece and at the same time the energy input is assisted by IR- or UV-sensitive absorber particles.

The coating of the substrate may be carried out by known methods, for example by spraying, doctor blading, brushing, roller application or dip coating. Metal oxides or metal nitrides, or alternatively metal oxynitrides, may be produced as ceramics. Metal sulfides or oxysulfides may also be produced as layer materials (for example molybdenum disulfide or tungsten disulfide). Known precursors are thiocarboxylic acids, alkane thiols and carboxylic acids, which are mixed with the corresponding metal salts. The following materials may be used for the absorber particles.

If the energy is supplied by a light source (IR or UV radiator), then it is generally possible to use all absorber materials in which the photons of a particular energy excite atoms or molecules of the absorber. Depending on the required temperature of the heat treatment (pyrolysis) and possibly required decomposition of the light-absorbing particles, absorber particles of inorganic and/or organic nature will be used. Examples of inorganic absorbers are the metal oxides: titanium dioxide, zinc oxide, silicon dioxide, tin dioxide or copper oxide. As organic IR absorbers, the various phthalo-, naphthalo- and carbocyanines, polymethines, and methylene chloride may be mentioned.

For the input of microwaves, absorbers are selected which have molecules with dipole moments and respond to alternating electromagnetic fields (for example TiN, CuCr, ZrO, SiO, BO, AgCr, AuCr, CrCu, iron ferrites $Fe_2O_3$ or $Fe_3O_4$, which are magnetized by addition of nickel, zinc or manganese compounds).

The absorber particles used have characteristic excitation frequencies, which need to be taken into account when configuring the excitation energy sources. Typical excitation frequencies of some absorbers for microwave radiation are listed in the following table.

| Material | Excitation frequency |
|---|---|
| Titanium nitride | 18589 MHz |
| Boron oxide | 2570 GHz |
| $BO_2$ | |
| BO | |
| Boron carbide | 53165 MHz |
| Silver-chromium | 1.701 GHz |
| Gold-chromium | 168 MHz |
| Chromium-copper | 0.14 GHz |
| SiO | 797 MHz |

Absorbers whose atoms or molecules are excited both by photons and by alternating electromagnetic fields may likewise be used (for example synthetic mixed iron-manganese oxide $(Fe,Mn)_2O_3$, available as Bayferrox® 303 T from the company Lanxess Deutschland GmbH).

In the coating material, the base constituents may function simultaneously as microwave absorbers (for example acetic acid at 5 GHz or propionic acid at 2.5 GHz as a solvent or diluent) or as IR absorbers (addition of metalorganic compounds as carboxylates, alkoxides or mixtures thereof, for example titanium 2-ethylhexanoate, zinc 2-ethylhexanoate, which form the corresponding metal oxides "in situ" during the pyrolytic decomposition) and accelerate the chemical conversion into a ceramic coating material. In the case of zirconium oxide, a microwave absorber is available which is obtained by pyrolysis from zirconium 2-ethylhexanoate and propionic acid and then accelerates the overall reaction, while simultaneously forming a part of the coating material. Iron oxide, which can act as an IR absorber and as a microwave absorber, can likewise be produced from iron 2-ethylhexanoate and propionic acid by pyrolytic decomposition during the heat treatment.

The absorbers may be used as both micro- and nanoparticles in the precursor solutions. Supporting addition in the form of solutions, suspensions and dispersions of suitable absorbers is likewise possible.

Depending on the layer structure, these light-absorbing particles will be added in the entire layer or in individual coats.

Above all, workpieces coated over a large area can now be irradiated with a light field (IR, UV) without special techniques. By the energy input which takes place with the aid of the absorber particles, the necessary reaction energy is obtained in the precursor layer. The required chemical conversion of the precursor into a ceramic layer therefore takes place. As absorbers at higher pyrolysis temperatures >350° C., inorganic substances may predominantly be used, for example zinc oxide, aluminum oxide, titanium dioxide, silicon dioxide, copper oxide, synthetic iron oxide $Fe_3O_4$, synthetic mixed iron-manganese oxide $(Fe,Mn)_2O_3$, tin dioxide in undoped or doped form. For example, antimony-doped tin dioxide is commercially available as an IR absorber under the product reference Minatec® 230 A-IR from the company Merck. The synthetic iron oxides are available under the product names Bayferrox® 306 and Bayoxide® E 8611, and the synthetic mixed iron-manganese oxide is available under the reference Bayferrox® 303 T from the company Lanxess Deutschland GmbH.

IR absorbers of organic composition may also be added to coating substances (precursors) for which pyrolysis can take place <300° C. Various phthalo-, naphthalo- and carbocyanines, polymethines and methylene chloride may be used as organic absorbers.

Examples of phthalocyanines are:

zinc 2,9,16,23-tetra-tert-butyl-29H,31H-phthalocyanine silicon 2,9,16,23-tetra-tert-butyl-29H,31H-phthalocyanine dichloride copper(II) 2,9,16,23-tetra-tert-butyl-29H,31H-phthalocyanine silicon(IV) phthalocyanine bis(trihexylsilyloxide)

These compounds are commercially available from the company Aldrich.

Further products, which likewise belong to the group of phthalocyanines, are PRO-JET™ 800NP, PRO-JET™ 830NP and PRO-JET™ 900NP from the company Fujifilm.

Examples of naphthalocyanines:

vanadyl 2,11,20,29-tetra-tert-butyl-2,3-naphthalocyanine nickel(II) 2,11,20,29-tetra-tert-butyl-2,3-naphthalocyanine zinc 2, 11,20,29-tetra-tert-butyl-2,3-naphthalocyanine 2, 11,20, 29-tetra-tert-butyl-2, 3-naphthalocyanine These compounds are commercially available from the company Aldrich.

Examples of Carbocyanines:

Products from the company Aldrich are IR-780 iodide, IR-786 iodide, IR-780 perchlorate, IR-786 perchlorate, IR-792 perchlorate and IR-768 perchlorate.

The group of polymethines is contained in the product PRO-JET™ 830LDI and commercially available from the company Fujifilm.

IRA 980 from the company Excition contains the aforementioned methylene chloride.

The absorbers may be used as both micro- and nanoparticles in the precursor solutions.

Addition in the form of solutions, suspensions and dispersions of suitable absorbers is likewise possible.

Minor additions of metalorganic compounds of the aforementioned metals (alkoxides, carboxylates or mixtures of the two) can likewise function as IR absorbers, which then form the corresponding IR-absorbing metal oxides in situ by pyrolytic decomposition, which then accelerate the overall reaction.

The required temperature for the chemical conversion of the precursor can be adjusted according to the concentration of the absorber.

The production of metal oxides and nitrides, from precursors which may be organic and/or inorganic solutions, dispersions and suspensions, is generally known.

The following exemplary embodiments present possibilities for the formation of layers by the method:

Example 1

The coating materials are prepared for a multilayer coating of three coats a, b and c. The precursor component for the first coat a on the substrate contains particles which absorb microwaves. Light-absorbing particles (absorber particles) are added to the precursor component for the second layer b. By the simultaneous use of a light field (UV or IR radiators) and microwaves, energy is input into the intermediate layers since the precursor becomes heated starting from the inner layer in the direction of the outer layer. By controlled incorporation of the absorber particles for enhanced input of both IR or UV rays and microwaves, heating of the coating material (precursor) can take place during the chemical conversion from the inside (close to the substrate) outward (close to the surface) up to a layer thickness in the cm range.

Example 2

The coating materials (precursors) are prepared for a multilayer coating of three coats a, b and c. The precursor component for the first coat a on the substrate contains light-absorbing particles (absorber particles). By irradiation with the light field, energy is input into the intermediate coat b since the precursor becomes heated starting from the inner layer in the direction of the outer layer. By controlled incorporation of the absorber particles, uniform heating of the precursor can take place during the chemical conversion from the inside outward.

Example 3

The light-absorbing particles (absorber particles) are added to a coating material (precursor) for a layer, but only in regions with an increased layer thickness. The inside of a tube is coated with this precursor. The regions of increased layer thickness lie in tube sections with increased tube friction (for example tube curves). Irradiation is subsequently carried out by an infrared and heating probe. The chemical conversion of the precursor into a protective ceramic layer therefore takes place, it being possible for the treatment time in the regions of increased layer thickness to be just as long as in the thinner regions because of the additional activation of the light-absorbing particles. The probe can therefore travel through the tube with a constant speed without taking account of the individual region.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
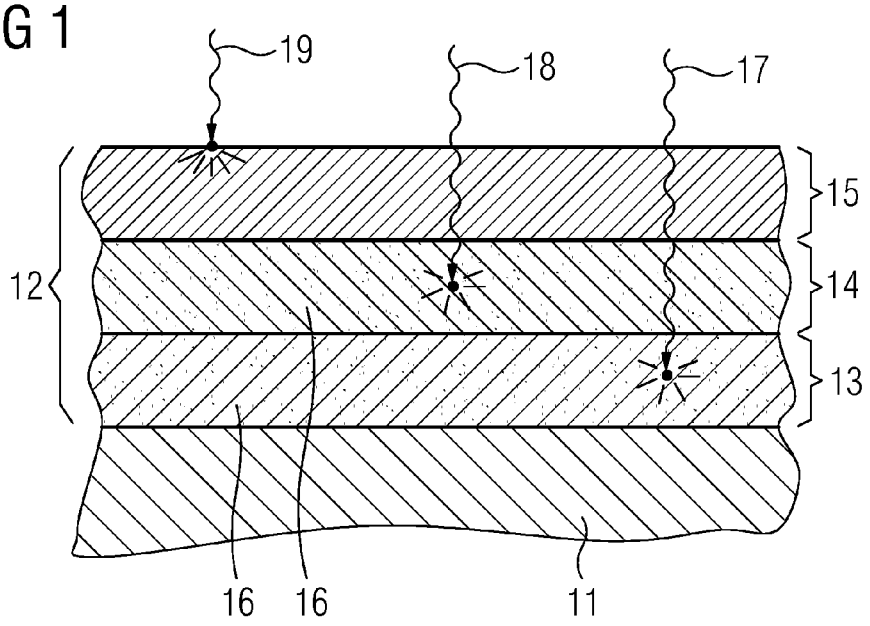
FIG. 1 is a cross sectional view through a multilayer coating, produced according to an exemplary embodiment of the method.

Reference will now be made in detail to the preferred embodiments, examples of which are illustrated in the accompanying drawings, wherein like reference numerals refer to like elements throughout.

FIG. 1 represents a substrate 11, on which a coating material has been applied in the form of layer 12. This layer has an (inner) coat 13 lying on the substrate, a central coat 14 and an upper (outer) coat 15. The coat 13 contains absorber particles 16 which can be excited by microwaves 17. The coat 14 is provided with absorber particles 16 which can be excited by IR radiation 18. The coat 15 does not have any absorber particles.

During the subsequent heat treatment, thermal radiation 19 is input into the layer 15 and gradually propagates throughout the layer, starting from the surface of the layer. The input of heat is, however, also assisted by the IR radiation 18 and the microwave radiation 17, which contributes to direct heating of the coats 14 and 13 by absorption in the absorber particles 16. In this case, it is necessary to ensure that the absorber particles 16 lie within the maximum penetration depth of the radiation in question.

Figure 2:
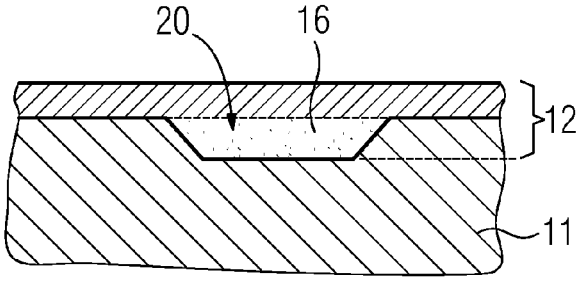
FIG. 2 is a cross sectional view through a layer with a different layer thickness, produced according to another exemplary embodiment of the method.

FIG. 2 represents a substrate 11 which has an indentation 20. This is filled by the layer 12, absorber particles 16 being added to the coating material in the region of the indentation 20 in order to accelerate the input of heat by the subsequent heat treatment in this region.

Figure 3:
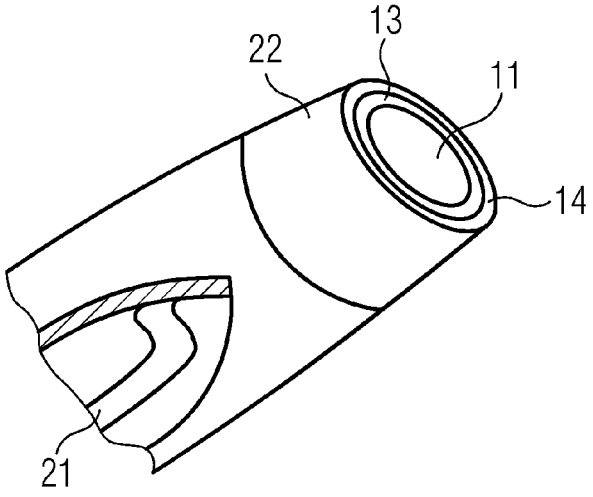
FIG. 3 is a perspective view of a component with different layer zones, produced according to a further exemplary embodiment of the method.

FIG. 3 represents a complex component which forms the substrate 11. It is essentially configured cylindrically and coated with two coats 13, 14 in the region of the lateral surface. The coat 13, which can be seen in the region of the cutaway of the coat 14, has a volume component 21 that is configured as a conductor track. To this end, in this volume component a coating material is selected which, besides the precursors for the ceramic, also contains metal particles which provide the electrical conductivity of this volume component after the heat treatment has been carried out.

On the front end of the substrate 11, the layer 14 includes a region 22 which has a different layer composition to the rest of the coat 14. This region contains of ceramics which have a higher wear resistance, so that this region may for example be used as a sliding bearing.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A method for producing a layer on a substrate, comprising:

applying a first coating material, including first absorber particles that absorb a first electromagnetic energy radiation, providing only a first portion of a volume of the layer;

applying at least one second coating material on the first coating material, providing a second portion of the volume of the layer and containing a solvent or dispersion medium, chemical precursors of a ceramic, and second absorber particles that permit propagation of the first electromagnetic energy radiation, absorb a second electromagnetic energy radiation, different from the first electromagnetic energy radiation, and differ from the first absorber particles with respect to at least one of chemical composition and a mixing ratio of different types of component absorber particles; and heat treating the substrate after application of the first and at least one second coating materials, whereby the solvent or dispersion medium is evaporated and the chemical precursors are converted into the ceramic so as to form the layer, including input of the first and second electromagnetic energy radiation which are respectively converted into heat by the first and second absorber particles, the first electromagnetic energy radiation able to penetrate the layer only to a first maximum penetration depth within the first portion, and the second electromagnetic energy radiation able to penetrate the layer only to a second maximum penetration depth within the second portion.

2. The method as claimed in claim 1, wherein the first coating material and the at least one second coating material are applied in at least two coats.

3. The method as claimed in claim 2, further comprising applying, on the at least one second coating material, a third coating material without absorber particles which forms a top coat during said heat treating.

4. The method as claimed in claim 3, wherein the first absorber particles in the first coating material absorb microwaves, and wherein at least some of the second absorber particles in at least one of the at least one second coating material, absorb at least one of infrared and ultraviolet light.

5. The method as claimed in claim 4, wherein said heat treating includes using a sequence of energy radiations in succession, by which the first and second absorber particles in the first and at least one second coating material are heated in succession.

6. The method as claimed in claim 5, wherein at least one of the first and at least one second coating materials is applied on the substrate with regions of different thickness, and comparatively more of at least one of the first and second absorber particles are used in first regions that are thicker than second regions.

7. The method as claimed in claim 4, wherein at least one of the first and at least one second coating materials is applied on the substrate with regions of different thickness, and comparatively more of at least one of the first and second absorber particles are used in first regions that are thicker than second regions.

8. The method as claimed in claim 3, wherein said heat treating includes using a sequence of energy radiations in succession, by which the first and second absorber particles in the first and at least one second coating material are heated in succession.

9. The method as claimed in claim 8, wherein at least one of the first and at least one second coating materials is applied on the substrate with regions of different thickness, and comparatively more of at least one of the first and second absorber particles are used in first regions that are thicker than second regions.

10. The method as claimed in claim 2, wherein the first absorber particles in the first coating material absorb microwaves, and wherein at least some of the second absorber particles in at least one of the at least one second coating material, absorb at least one of infrared and ultraviolet light.

11. The method as claimed in claim 10, wherein said heat treating includes using a sequence of energy radiations in succession, by which the first and second absorber particles in the first and at least one second coating material are heated in succession.

12. The method as claimed in claim 11, wherein at least one of the first and at least one second coating materials is applied on the substrate with regions of different thickness, and comparatively more of at least one of the first and second absorber particles are used in first regions that are thicker than second regions.

13. The method as claimed in claim 1, wherein the first and second absorber particles the first absorber particles absorb microwaves and the second absorber particles absorb light.

14. The method as claimed in claim 1, wherein the first electromagnetic energy radiation is microwave radiation and the second electromagnetic energy radiation is at least one of UV and infrared light.

* * * * *

UNITED STATES PATENT AND TRADEMARK OFFICE

CERTIFICATE OF CORRECTION

PATENT NO. : 9,200,370 B2
APPLICATION NO. : 13/322432
DATED : December 1, 2015
INVENTOR(S) : Christian Doye et al.

It is certified that error appears in the above-identified patent and that said Letters Patent is hereby corrected as shown below:

In the claims
Claim 13, Column 9, Lines 18-19:
Delete "the first and second absorber particles"

Signed and Sealed this
Twenty-second Day of March, 2016

Michelle K. Lee

Michelle K. Lee
*Director of the United States Patent and Trademark Office*